US006464376B1

(12) United States Patent
Willson

(10) Patent No.: US 6,464,376 B1
(45) Date of Patent: Oct. 15, 2002

(54) BEAM STEERING APPARATUS

(75) Inventor: Peter D. Wynne Willson, London (GB)

(73) Assignee: Wynne Willson Gottelier Limited (GB)

( * ) Notice: Subject to any disclaimer, the term of this patent is extended or adjusted under 35 U.S.C. 154(b) by 0 days.

(21) Appl. No.: 09/622,163

(22) PCT Filed: Feb. 12, 1999

(86) PCT No.: PCT/GB99/00455

§ 371 (c)(1),
(2), (4) Date: Sep. 22, 2000

(87) PCT Pub. No.: WO99/41544

PCT Pub. Date: Aug. 19, 1999

(30) Foreign Application Priority Data

Feb. 13, 1998 (GB) ..... 9803108

(51) Int. Cl.[7] ..... F21V 14/04
(52) U.S. Cl. ..... 362/284; 362/324; 362/346
(58) Field of Search ..... 362/275, 283, 362/321, 322, 284, 324, 264, 285, 346, 35

(56) References Cited

U.S. PATENT DOCUMENTS

| | | | | | |
|---|---|---|---|---|---|
| 4,729,071 | A | | 3/1988 | Solomon | 362/35 |
| 4,931,916 | A | * | 6/1990 | Callahan | 362/296 |
| 5,333,102 | A | * | 7/1994 | Oberman et al. | 362/284 |
| 5,537,303 | A | * | 7/1996 | Stacy | 362/284 |
| 5,590,955 | A | * | 1/1997 | Bornhorst et al. | 362/284 |
| 5,696,637 | A | | 12/1997 | Shaffer | 359/857 |
| 5,788,365 | A | * | 8/1998 | Hunt et al. | 362/346 |
| 5,860,733 | A | * | 1/1999 | Stone et al. | 362/322 |

FOREIGN PATENT DOCUMENTS

| | | |
|---|---|---|
| EP | 0 564 828 A1 | 10/1993 |
| EP | 0 643 257 A1 | 3/1995 |

OTHER PUBLICATIONS

International Search Report of International Application No. PCT/GB99/00455 mailed May 12, 1999.

* cited by examiner

*Primary Examiner*—Sandra O'Shea
*Assistant Examiner*—Peggy A. Neils
(74) *Attorney, Agent, or Firm*—Sterne, Kessler, Goldstein & Fox P.L.L.C.

(57) ABSTRACT

Beam steering apparatus comprising an apparatus body and means in the body for generating a beam. First and second rotatable reflectors are provided for deflecting the beam in different directions, the beam being deflectable by the first reflector onto the second reflector so as to deflect the beam substantially in any direction. The apparatus is further provided with a first motor for rotating one of the reflectors and for driving a first input to a gearbox. A second motor is provided for driving a second input to the gearbox, the gearbox having an output for rotating the other reflector. The first and second motors are housed in the body. The gearbox output rotates the second reflector via a drive belt. The rotation of the first reflector induces rotation of the second reflector. The gearbox inputs and output are arranged to compensate for the induced rotation such that rotation of the second reflector by the second motor is unaffected by any rotation of the first reflector.

27 Claims, 7 Drawing Sheets

FIG. 5
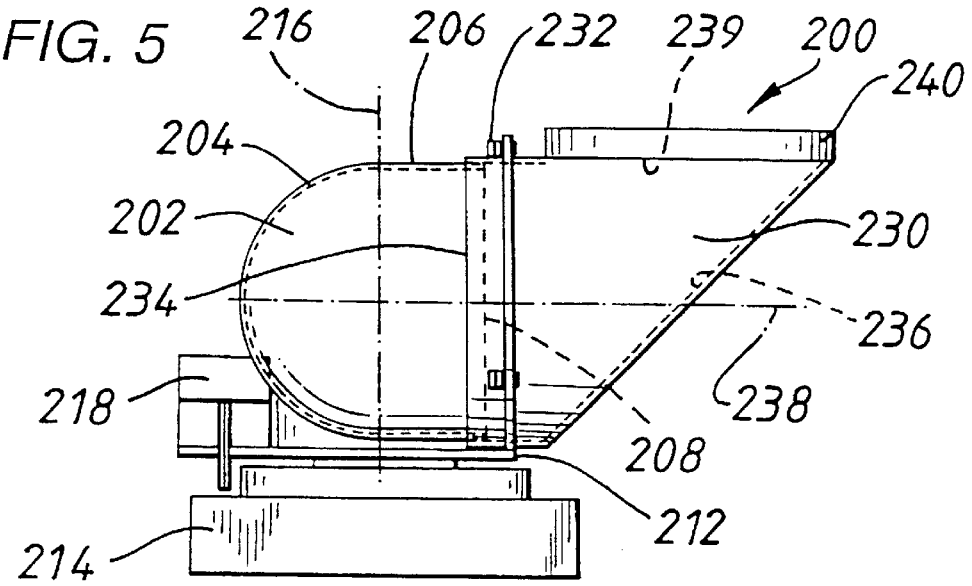
FIG. 6
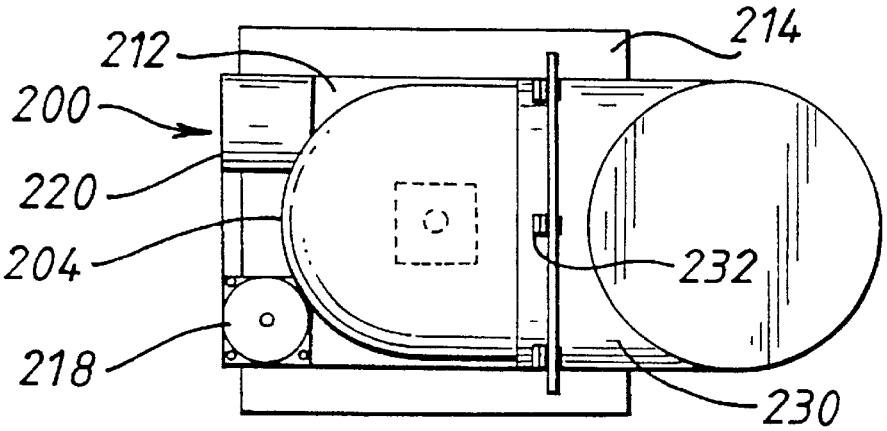
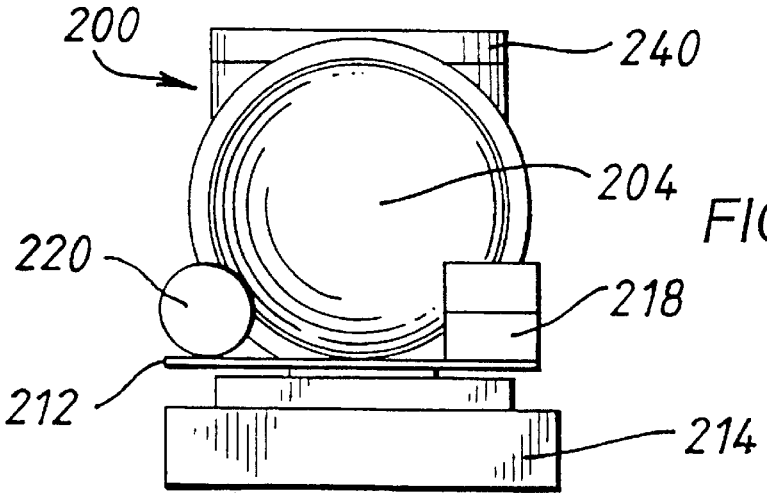
FIG. 7

BEAM STEERING APPARATUS

This invention relates to beam steering apparatus, in particular to apparatus for steering a beam of visible light, infra red radiation, any other electromagnetic wave or ultrasonic sound in any direction.

Apparatus for directing a beam of light by rotatable mirrors is known from U.S. Pat. No. 4,663,698 and is illustrated schematically in FIG. 1. The apparatus comprises a first mirror 10 on a rotating first support, or "pan", 12 which is mounted to apparatus body 14. The body 14 includes a light source, such as a lamp 16, and focusing arrangement 18. Using a belt drive, the pan 12 is rotatable about pan axis 20 by a motor 22 mounted on the body 14.

A second mirror 24 on a rotating second support, or "tilt", 26 is mounted on the pan 12. Using another belt drive, the tilt 26 is rotatable about tilt axis 28, orthogonal to the pan axis 20, by a motor 30 mounted on the body 14. This arrangement of rotatable mirrors can direct light in many directions.

As the pan 12 rotates, it carries the relatively large weight of the motor 30 for the tilt 26, the motor 30 rotating eccentrically about the pan axis 20. The weight of the motor 30 strains the pan mounting and adds to the required output level of the motor 22 for rotating the pan 12. It is known to provide a counterbalance to compensate for the eccentric movement of the motor 30 in order to avoid straining of the mounting of the pan 12. This latter arrangement, however, further adds to the load on the pan motor. Moreover, the pan 12 cannot be rotated continuously.

U.S. Pat. No. 4,827,387 and U.S. Pat. No. 4,945,459 describe similar lighting apparatus in which by use of belt drives both motors are mounted in a stationary position on the apparatus body. With reference to FIG. 2, motors 22 and 30 are rigidly mounted to a bottom plate 40 of the body of the apparatus.

A drive pulley 42 for the pan 12 is mounted to the pan 12 for rotation about the pan axis 20. The drive pulley 42 is driven by a drive belt 44 which passes around a drive gear 46 mounted on the pan motor 22.

A pair of coupled drive pulleys 48 for the tilt 26 also rotate about the pan axis 20. Similar to the drive pulley 42, one of the drive pulleys 48 is driven by a drive belt 50 which passes around a drive gear 52 mounted on the tilt motor 30. Another drive belt 54 passes around the other one of the drive pulleys 48, around a pair of idler gears 56 and then around a tilt-axis drive pulley 58 mounted to the tilt 26. The gear ratio between the pan motor 22 and the pan 20 is the same as that between the tilt motor 30 and the tilt 26.

As illustrated in FIG. 2, the drive belt 50 driven by the tilt motor 30, which belt acts to rotate the tilt 26, passes around the pan 12. Therefore, if the tilt motor 30 is held stationary and the assembly is driven about the pan axis 20, there is relative movement between the tilt axis 22 and the drive belt 54 as the tilt 26 is "panned" about the pan axis 20. As a result, rotation of the pan 12 will induce rotation of the tilt 26.

Whilst, in this arrangement, the pan is rotatable continuously, in order to achieve a desired movement of the tilt 26 a calculation must be made of the desired tilt movement plus (or minus) a compensation for any simultaneous movement that may occur of the pan 12. For example, to maintain the tilt 26 at a constant tilt angle for a given angular velocity of the pan, the tilt 26 must be driven at the same angular velocity and in the same direction as the pan 12. To rotate the tilt 26 at same angular velocity and in a same direction as the pan 12, the tilt 26 must be driven at twice the angular velocity and in the same direction as the pan 12.

The result is that to achieve certain combinations of pan speed and tilt speed, the output from the tilt motor 30 is required to be significantly higher when the pan 12 is being driven by the pan motor 22 than when the pan 12 is stationary.

In both of these arrangements, the optical length of the apparatus, that is the distance between the light source 16 and the aperture 60 of the tilt 26 tends to be long. For example, with an aperture size of 8 inches (20 cm), which is typical for apparatus for use in a theatre or discotheque, the optical length is approximately 4 feet (120 cm), with the result that only a beam of relatively narrow angle is output from the apparatus.

The present invention has the object of providing beam steering apparatus in which the problems and disadvantages identified in the prior art are overcome or at least ameliorated.

The present invention is applicable to a range of different types of radiation and energy, all of which have a common characteristic, namely that they are transmitted in a form that has the wave-like properties of reflection and diffraction and that has measurable frequency and wave length. Examples include, but are not limited to, ultra violet, infra red and visible light, ultrasound, audible sound, microwaves and mixtures of one or more of the aforementioned. References in the specification to "beam" are intended to refer to any such radiation or energy in wave-like form.

The present invention provides beam steering apparatus comprising:

first and second rotatable reflectors for deflecting a beam in different directions, the beam being deflectable by the first reflector onto the second reflector so as to deflect the beam substantially in any direction;

a first motor for rotating one of the reflectors and for driving a first input to a gearbox; and a second motor for driving a second input to the gearbox, the gearbox having an output for rotating the other one of the reflectors.

The term "reflector" used herein includes both non-planar reflectors, having, for example, a concave surface (such as a spherical, parabolic or ellipsoidal surface), and planar reflectors, commonly referred to as "mirrors". The term also includes non-planar reflectors in which the optical centre of the reflector is spaced from the geometric centre of the reflector.

The present invention also extends to a method of deflecting a beam by deflecting the beam off a first reflector on to a second reflector, and rotating both reflectors so as to deflect the beam substantially in any direction, the method comprising the steps of:

providing a first motor to rotate the one of the reflectors and to drive a first input to a gearbox;

providing a second motor to drive a second input to the gearbox; and rotating the other one of the reflectors from the output of the gearbox.

The first motor may be arranged to rotate the first reflector and the output may be arranged to rotate the second reflector.

The use of a gearbox to drive one of the reflectors enables wide variations in the required output from, for example, the motor driving the tilt, to be avoided when a belt for driving the tilt passes around the pan.

Preferably, the gearbox is a summation gearbox.

In a preferred embodiment, the first reflector is arranged to rotate about a first axis and the second reflector is arranged to rotate about a second axis substantially orthogonal to the first axis.

The apparatus may include means for generating a beam. However, the apparatus may be provided as an accessory to be attached to a light source or other such beam generating means.

The present invention also provides beam steering apparatus, comprising:

means for generating a beam;

means for rotating the generating means so as to rotate the beam;

a rotatable reflector for deflecting the beam; and means for rotating the reflector so as to deflect the beam substantially in any direction.

With the above arrangement, only one mirror is used to direct light in substantially any direction. This enables the optical length of the apparatus to be reduced, and a wide angle beam to be output from the apparatus.

The generating means may comprise a housing and a beam source may be disposed within the housing, the housing having an aperture for outputting a beam generated by the beam source. The housing may be rotatable about the beam source so as to rotate the aperture about the beam source, the beam source being stationary.

The generating means may be rotatable about a first axis, the beam source being spaced from the first axis. Alternatively, the first axis may pass through said beam source, giving the appearance that the aperture is rotating around the source whilst the source "spins" on its axis.

A part of the housing may comprise a non-planar reflector for focusing a beam generated by the source on to the rotatable reflector, and the spacing between the non-planar reflector and the source may be variable to focus the generated beam. Additionally, or alternatively, the spacing between the non-planar reflector and the generating means may be variable to focus the generated beam.

The apparatus may further comprise means for focusing the beam disposed between the generating means and the rotatable reflector, and the spacing between the focusing means and the generating means may be variable to focus the generated beam. Alternatively, or additionally, the apparatus may further comprise means for focusing the beam reflected from the rotatable reflector.

Various devices for modifying the beam output from the light source may be removably provided inside the apparatus. For example, the apparatus may further comprise a gobo disposed between the rotatable reflector and the means for focusing the beam reflected from the rotatable reflector. In addition, or alternatively, the apparatus may further comprise at least one of a colour changer, colour-mixer, framing shutters, iris-type diaphragm and a diffuser disposed between the generating means and the focusing means. There may be provided means for moving at least one of a gobo and framing shutters along the optical path of the apparatus, thereby enabling the definition of the image projected by the apparatus to be easily changed. There may also be provided means for rotating said at least one of a gobo and framing shutters, for example, to compensate for the rotation of the rotatable reflector.

The apparatus may further comprise a housing for the rotatable reflector, the reflector housing comprising an aperture for outputting a beam from the apparatus, the aperture including means for preventing a beam which has not been reflected by the rotatable reflector from being output from the apparatus. This arrangement can ensure that only a beam that is travelling in the desired direction, that is, after being reflected by the rotatable reflector, is output from the apparatus. The preventing means may comprise a collimator mounted on the aperture.

The generating means may be arranged to rotate about a first axis and the rotatable reflector may be arranged to rotate about a second axis substantially orthogonal to the first axis.

The apparatus may further comprise a first motor for rotating the generating means and for driving a first input to a gearbox, and a second motor for driving a second input to the gearbox, the gearbox having an output for rotating the reflector.

The present invention also provides a method of deflecting a beam, comprising the steps of:

generating a beam;

rotating the generating means so as to rotate the generated beam;

providing a reflector for deflecting the generated beam; and rotating the reflector so as to deflect the beam substantially in any direction.

The generating means may comprise a housing and a beam source disposed within the housing, the housing having an aperture for outputting a beam generated by the beam source, the method comprising rotating the housing about the beam source so as to rotate the aperture about the beam source.

The invention is now described in a specific embodiment with reference to the accompanying drawings in which:

FIG. 5 shows a side view of a second embodiment of a beam steering apparatus;

FIG. 6 shows a top view of the apparatus shown in FIG. 5;

FIG. 7 shows a rear view of the apparatus shown in FIG. 5;

Figure 1:
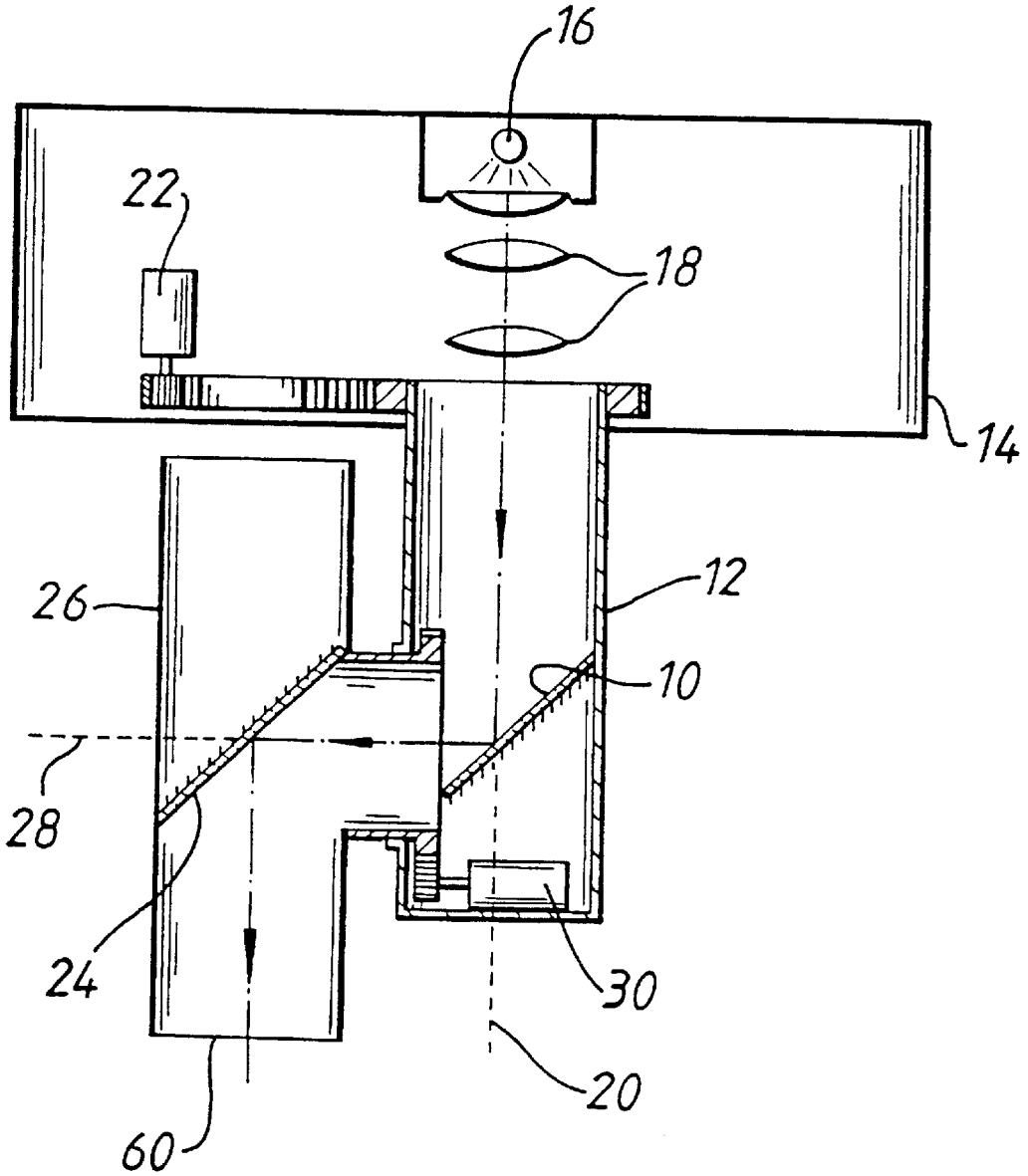
FIG. 1 (PRIOR ART)
FIG. 1 shows a schematic view of a known beam steering apparatus.
Figure 3:
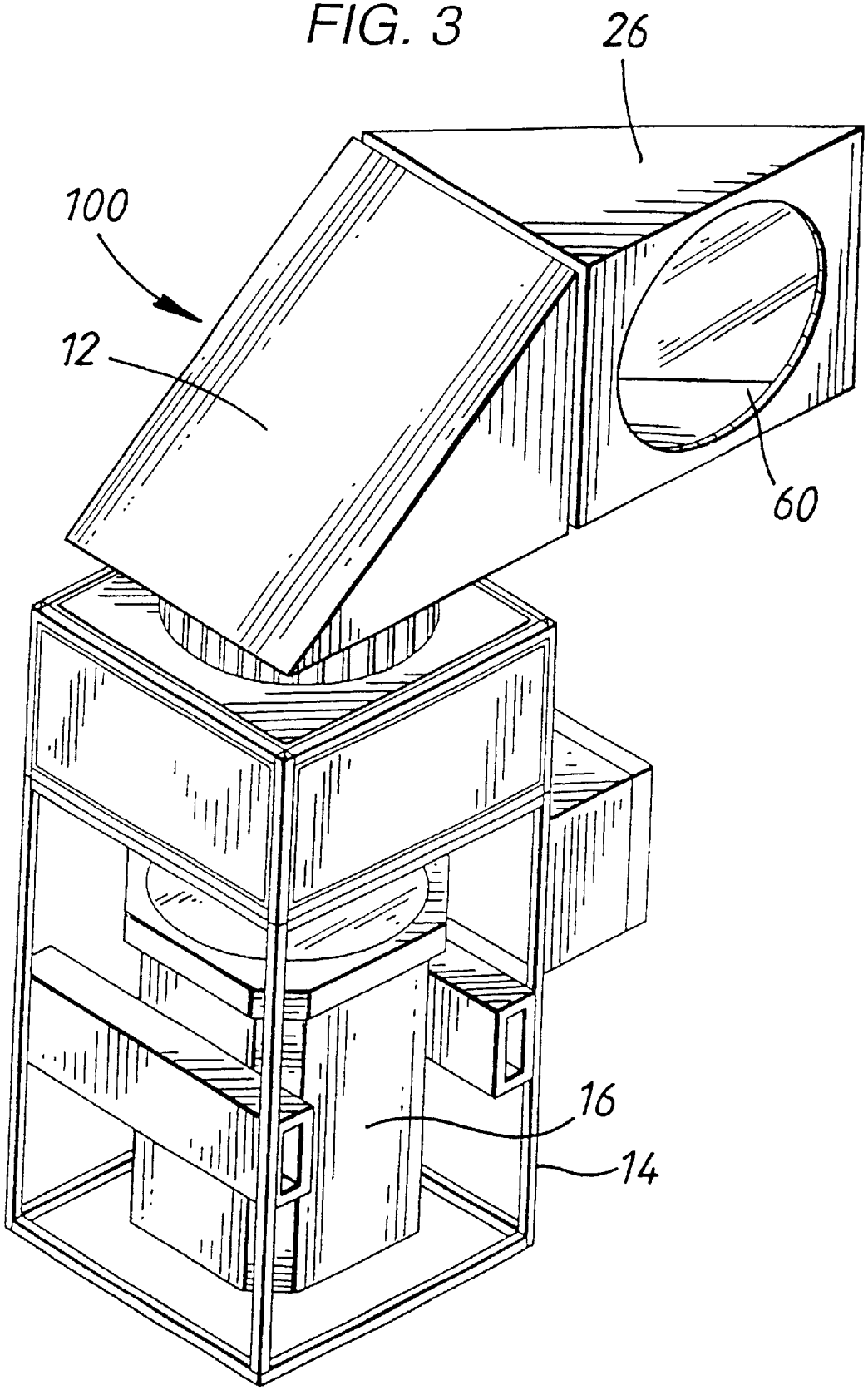
FIG. 3 shows an isometric view of a first embodiment of a beam steering apparatus.

With reference to FIG. 3, a first embodiment of a beam steering apparatus is shown generally as 100 and comprises a pan 12 mounted on an apparatus body 14, which includes a light source 16 and conventional focusing arrangement. Similar to the known apparatus described with reference to FIG. 1, the pan 12 includes a first planar reflector, such as a mirror, and the pan 12 is rotatable about a pan axis.

A tilt 26 is mounted on the pan 12. Again, similar to the known apparatus described with reference to FIG. 1, the tilt 26 includes a second planar reflector, such as a mirror, and is rotatable about a tilt axis substantially orthogonal to the pan axis so that the mirrors can direct light in substantially any direction for output through aperture 60. One or more beam focusing means, such as a lens, may be disposed at any suitable point within the apparatus.

Figure 4:
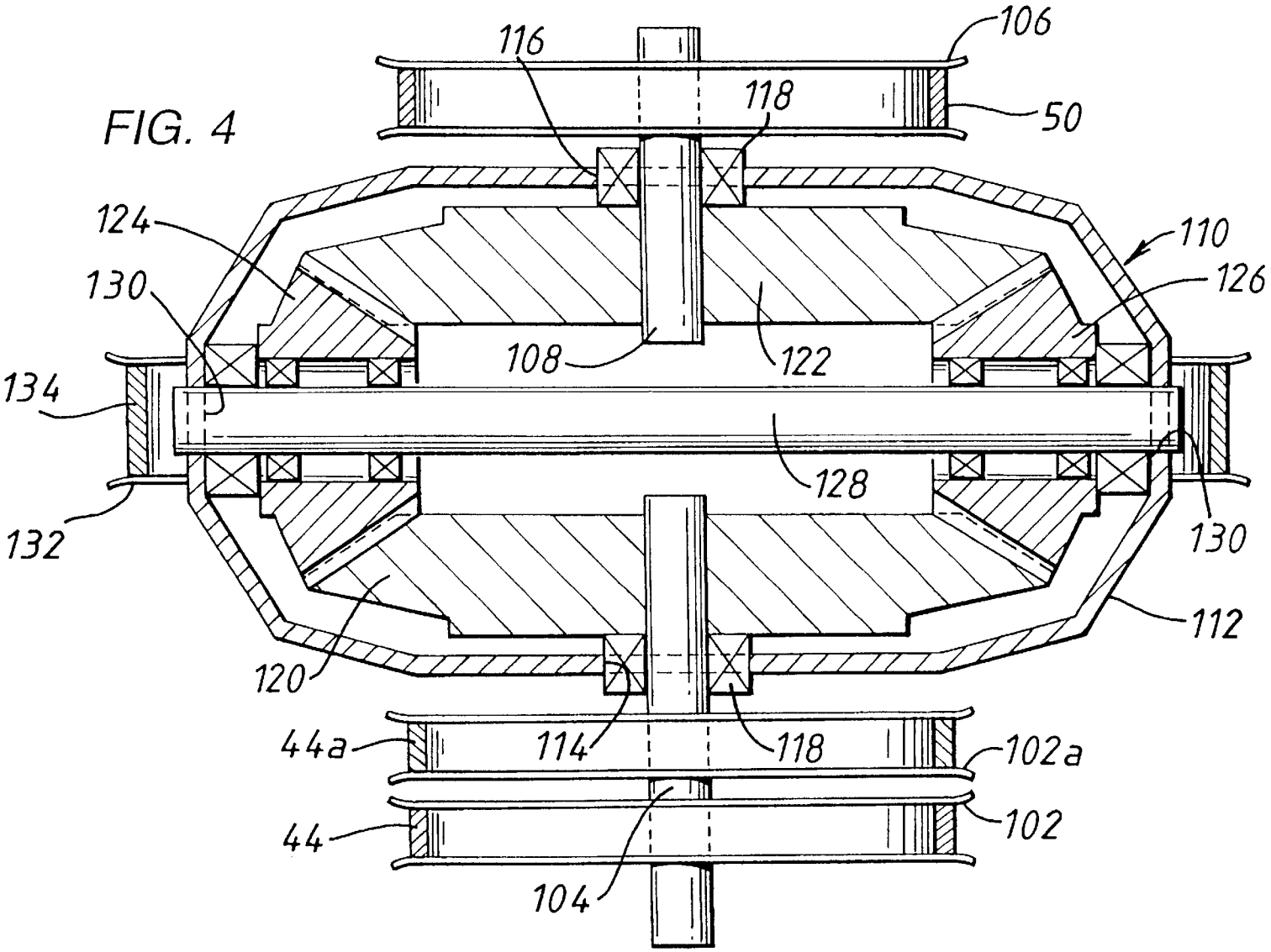
FIG. 4 shows a schematic diagram of a summation gearbox.

Motors for the pan 12 and tilt 26 are housed in the body 14 of the apparatus. FIG. 4 illustrates a gearing arrangement in the drive mechanism for the pan 12 and tilt 26. The arrangement includes many of the features of the known driving arrangement described with reference to FIG. 2, and so the same reference numerals will be used in respect of components similar to those shown in FIG. 2.

A pulley 102 is driven by a drive belt 44 which passes around a drive gear mounted on the pan motor. The pulley 102 is mounted on a pan drive shaft 104 for rotation by the pulley 102. A second pulley 102*a* is also mounted on the pan drive shaft 104 to drive belt 44*a*, which passes around a drive pulley for the pan 12 in a similar manner to the drive belt 44 in FIG. 2. It will be appreciated that the pulley 42, drive belt 44 and drive gear may be omitted so that the pan drive shaft 104 is driven directly by the pan motor.

Similar to the pulley 102, a pulley 106 is driven by a drive belt 50 which passes around a drive gear mounted on the tilt motor. The pulley 106 is mounted on a tilt drive shaft 108 for rotation by the pulley 106; it will be appreciated that the pulley 106, drive belt 50 and drive gear may be omitted so that the tilt drive shaft 108 is driven directly by the tilt motor.

Instead of the drive belt arrangement, any other conventional driving arrangement, such as ones using drive chains or gears, may be used.

The pan drive shaft 106 and tilt drive shaft 108 comprise input drives to a summation gearbox 110. The gearbox 110 includes a housing 112 which has an aperture 114 through which pan drive shaft 104 passes and an aperture 116 through which tilt drive shaft 106 passes, roller bearings 118 being provided between the shafts 104, 106 and the housing 112.

The housing 112 contains gears 120, 122, 124 and 126 of the summation gearbox 110. Gear 120 is attached to pan drive shaft 104 and gear 122, identical to gear 120, is attached to tilt drive shaft 108. Bevel gears 124 and 126 are driven by the gears 120 and 124, the ratio of gear 120 to gear 124 being 2:1. The bevel gears 124 and 126 drive output shaft 128 disposed diametrically within the housing 112 and extending therefrom via aperture 130. In turn, the output shaft 128 drives pulley 132 disposed circumferentially of the housing 112.

Figure 2:
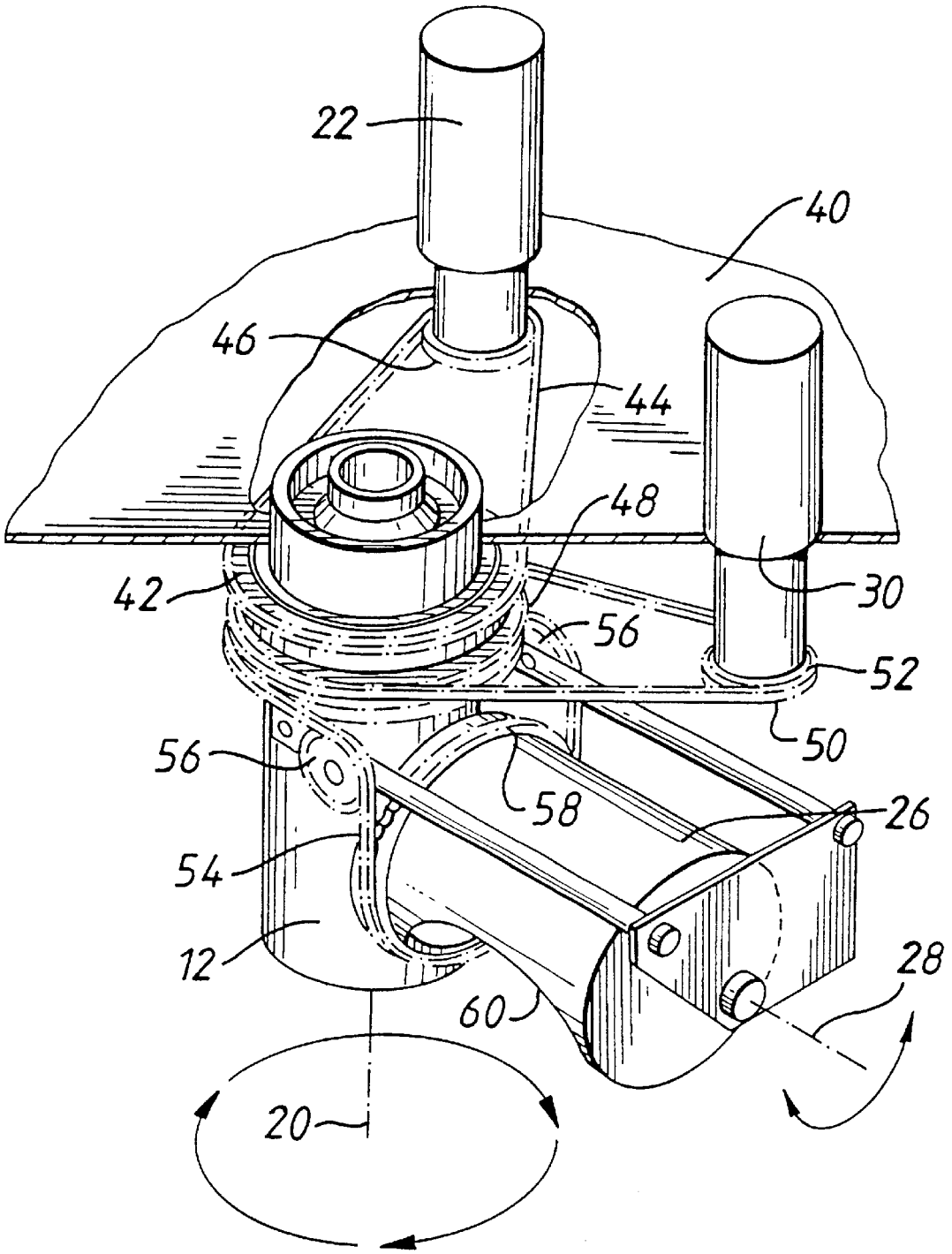
FIG. 2(PRIOR ART)
FIG. 2 shows a known driving arrangement for beam steering apparatus.

A drive belt 134 for the tilt 26 passes around the pulley 132, and in turn passes around a drive pulley for the tilt 26 in a similar manner to the drive belt 50 in FIG. 2. The ratio of the diameter of the pulley 132 to the diameter of each of the pulleys 102, 102*a* and 106 is 2:1.

With this arrangement, if the pan drive shaft 104 and the tilt drive shaft 108 rotate at the same angular velocity and in the same direction, the drive shaft 128 rotates at that angular velocity and in that direction. Compensating for the rotation of the pan 12, the tilt rotates at the same angular velocity as the tilt drive shaft 128.

If the pan drive shaft 104 is held stationary, the drive shaft 128 rotates at half of the angular velocity of the tilt drive shaft and in the same direction as the tilt drive shaft 108, so that the tilt rotates at the same angular velocity as the tilt drive shaft 108.

If the tilt drive shaft 108 is held stationary instead of the pan drive shaft, the drive shaft 128 rotates at half of the angular velocity of the pan drive shaft 104 and in the opposite direction to the pan drive shaft 108. Compensating for the rotation of the pan 12, the tilt does not rotate.

If the pan drive shaft 104 and the tilt drive shaft 108 rotate at the same angular velocity and in opposite directions, the drive shaft 128 is stationary. Compensating for the rotation of the pan 12, the tilt rotates at the same angular velocity as the tilt drive shaft 128.

As evident from the above analysis, the use of a gearbox such as the summation gearbox 110 enables the tilt to be rotated at the same angular velocity as the tilt drive shaft, irrespective of the angular velocity of the pan 12.

Whilst the above embodiment describes a particular gearing arrangement in the summation gearbox, it will, of course, be appreciated that the gearbox may include any other suitable gearing arrangement. In addition, whilst the embodiment describes the use of a summation gearbox, any driving arrangement may be used in which one drive shaft is driven directly by one motor and the other drive shaft is driven from the sum of the output of two motors.

The size of the aperture 60 is limited by the size of the commercially-available mirrors. Whilst aperture sizes of 18 inches (46 cm), suitable for concert arenas, and 28 inches (71 cm), suitable for outdoor stadia, are possible, aperture sizes of 48 inches (122 cm) and over are envisaged.

Another embodiment of a beam steering apparatus is now described with reference to FIGS. 5 to 7.

Apparatus 200 comprises a light source housed within a light chamber 202. The light chamber 202 comprises a domed portion 204 and a cylindrical portion 206 defining a circular aperture 208 of the light chamber 202. In a preferred embodiment, within the dome 204 is a concave, preferably parabolic, elliptical or spherical, reflector (not shown) with the light source situated at the focus of the concave reflector to provide a broad, parallel beam; this arrangement may be of advantage when the beam is a beam of ultrasound instead of light. However, the light source may be situated at any position in the light chamber 202 substantially equidistant from the internal walls of the cylinder 206. Instead of being a parallel beam, the beam may be converging or diverging, the apparatus including, if desired, suitable means for focusing the beam.

The diameter of the cylinder 206 may be larger than the diameter of the mouth of the dome 204. This arrangement can enable the concave reflector to move relative to the cylinder 206 to vary the distance between the concave reflector and the light source, thereby bringing the beam emitted by the light source into and out of focus to provide special lighting effects.

A tilt 230 is mounted to the light chamber 202 by means of a ring slide (not shown) running on journal bearings 232. The means by which the tilt 230 is mounted on the light chamber 202 is optional; the use of journal bearings together with a slide ring provides a simple and efficient (low-friction) mounting.

The tilt 230 has a circular aperture 234 larger than the aperture 208 of the light chamber for receiving a beam output from the light chamber 202.

The dome 204 is mounted on a plate 212 which is in turn mounted on body 214 of the apparatus 200. The plate 212 is rotatable about a central axis 216 to rotate the light chamber 202 so that a beam output from the aperture 208 of the chamber 202 sweeps out an arc. In this preferred embodiment, a stop 218 mounted on the plate 212 prevents the light chamber from rotating through 360°, the stop 218 limiting movement of the light chamber 202 to an arc of approximately 270°. However, such a stop may be omitted to enable full circular rotation of the light chamber. Alternatively, the stop 218 may be replaced by a sliding stop having an escapement to enable rotation of the light chamber through at least 360°, preferably through 720°.

A housing 220 for the electrical connections to the light source is also mounted to the plate 212.

The tilt includes a planar reflector 236, such as a mirror, at an angle of about 450° to the central axis. The mirror 236 may be replaced by any other planar or non-planar reflector. The tilt 230 is rotatable about 360° about tilt axis 238 substantially orthogonal to the central axis 216. A beam input to the tilt 230 through the aperture 234 is reflected by the mirror 236 and output through aperture 239. A collimator 240 is mounted on the aperture 239 to prevent any light which has not been reflected by the mirror 236 from being output from the apparatus 200. The collimator may take any appropriate form, such as, for example, a grid in the form of an array of hexagons or concentric circles.

As both the light chamber and the reflector are rotatable, by rotation of both the light chamber and reflector the beam can be deflected in substantially any direction across a hemispherical surface. This choice of beam direction is appropriate for the case that the apparatus is mounted on a flat surface, such as in the case of a ceiling-mounted or wall-mounted apparatus. By varying the construction of the apparatus the choice of beam direction can be adjusted so that the beam can be deflected in substantially any direction. This latter arrangement can be convenient for the case in which the apparatus is used to project a beam of light onto a distant surface.

Drive to the light chamber 202 and tilt 230 is achieved through any suitable means, such as first and second electrical motors mounted on the body 214 of the apparatus. The driving means may comprise an array of motors, gears and belts as described with reference to FIG. 2, or such an array including a summation gearbox as described with reference to FIG. 4. Stepper motors can be used. Each motor and/or chamber 202 and tilt 230 may be marked so as to enable resetting of the apparatus to a known starting position—whether upon initial use or in the middle of and during use. Servo devices and feedback potentiometers/encoders can be used to enable accurate feedback at all times of the relative positions of the various apparatus components.

In addition to, or alternative to, the concave reflector provided in the dome 204, various means for focusing the beam emitted by the light source may be provided. For example, an arrangement of one or more lenses may be disposed within the light chamber 202 between the light source and the tilt 230, and/or such an arrangement may be provided in the tilt 230 between the mirror 236 and the collimator 240. The positions of these focusing arrangements relative to the light source and mirror 236 respectively may be variable to provide special lighting effects. The weight of such focusing arrangements may be counterbalanced by attaching one or more weights to the plate 212 to ensure smooth rotation of both the light chamber 202 and tilt 230.

Various devices for modifying the beam output from the light source may be removably provided inside the apparatus. For example, at least one of a colour changer, colour mixer, iris-type diaphragm and/or a gobo may be provided next to any of the focusing arrangements and mirror hereinbefore described. It is optional for any known lighting effect to be incorporated into the reflectors for example the mirror or a part thereof could be a diffuser. The planar reflector or a part thereof could comprise a plurality of mirrors at different angles to each other, forming a mosaic of mirrors.

Figure 8:
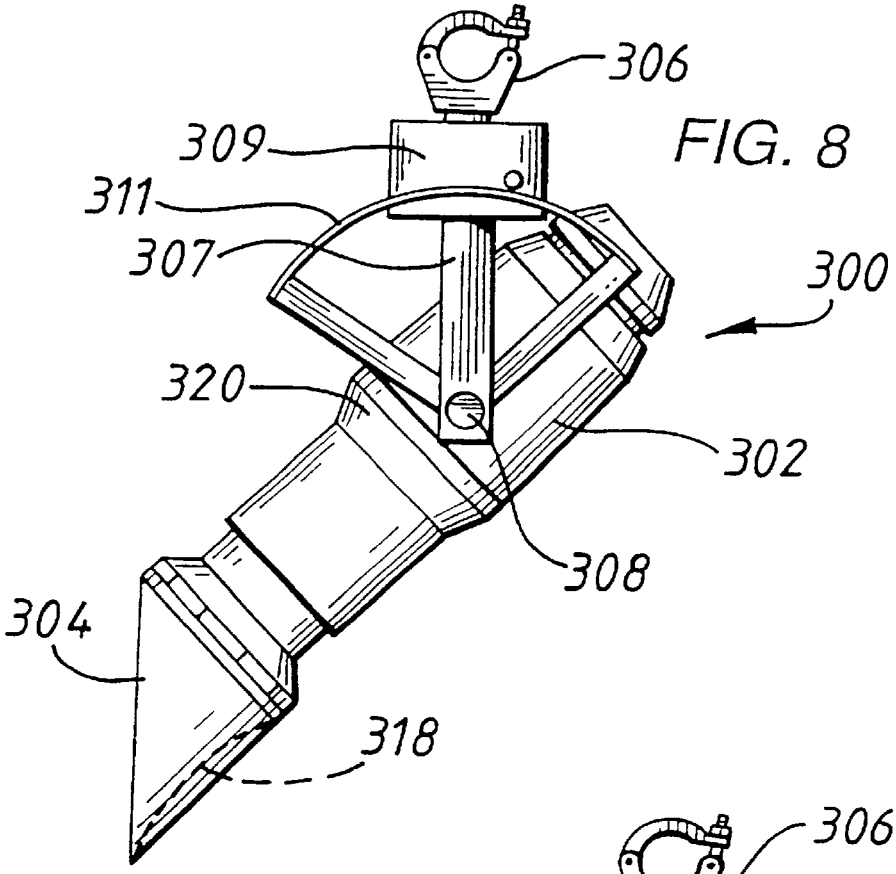
FIG. 8 shows a plan view of a third embodiment of a beam steering apparatus.

A third embodiment of a beam steering apparatus is shown in FIG. 8. Similar to the second embodiment described above, the apparatus 300 comprises a light chamber 302 and a pan 304 mounted to the light chamber 302 for rotation relative thereto. The light chamber 302 is attached to a fastener 306 via bracket 307 so as to enable pivotal tilt motion of the light chamber 302 about pivot 308. Rotation of the light chamber 302 and panning motion of the pan 304 can be provided by any suitable means, as discussed above. In the embodiment shown in FIG. 8, an array of motors for driving the light chamber 302 and the pan 304 is housed in housing 309.

The light chamber 302 can rotate through an arc of approximately 100°, although the arc of the quadrant 311 can be modified to enable the extent of rotation of the light chamber 302 to increase or decrease as required. The pan 304 can rotate through 360°, and so light can be output from the aperture 318 of the pan 304 over a wide directional range.

Figure 9:
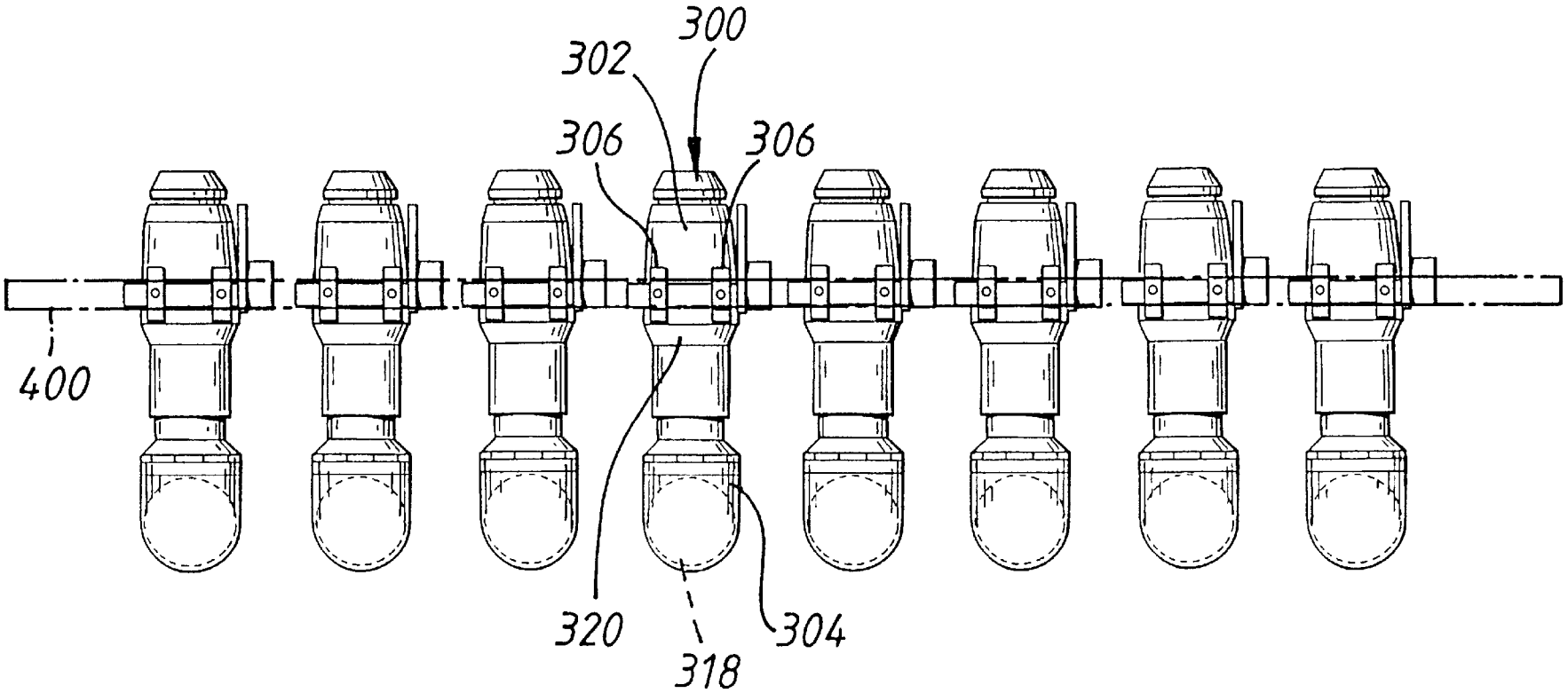
FIG. 9 shows a number of the apparatus shown in FIG. 8 mounted on a lighting rail.

The fastener 306 can take any suitable form, for example a clamp for enabling the apparatus to be mounted upon a fixed structure, such as a lighting rail in a theatre. As shown in FIG. 9, a row of apparatus 300 may be mounted on a single lighting rail 400, for example to direct a number of different optical effects over a stage. The shape of the apparatus 300 enables the apparatus to be mounted with a high linear density.

Figure 10:
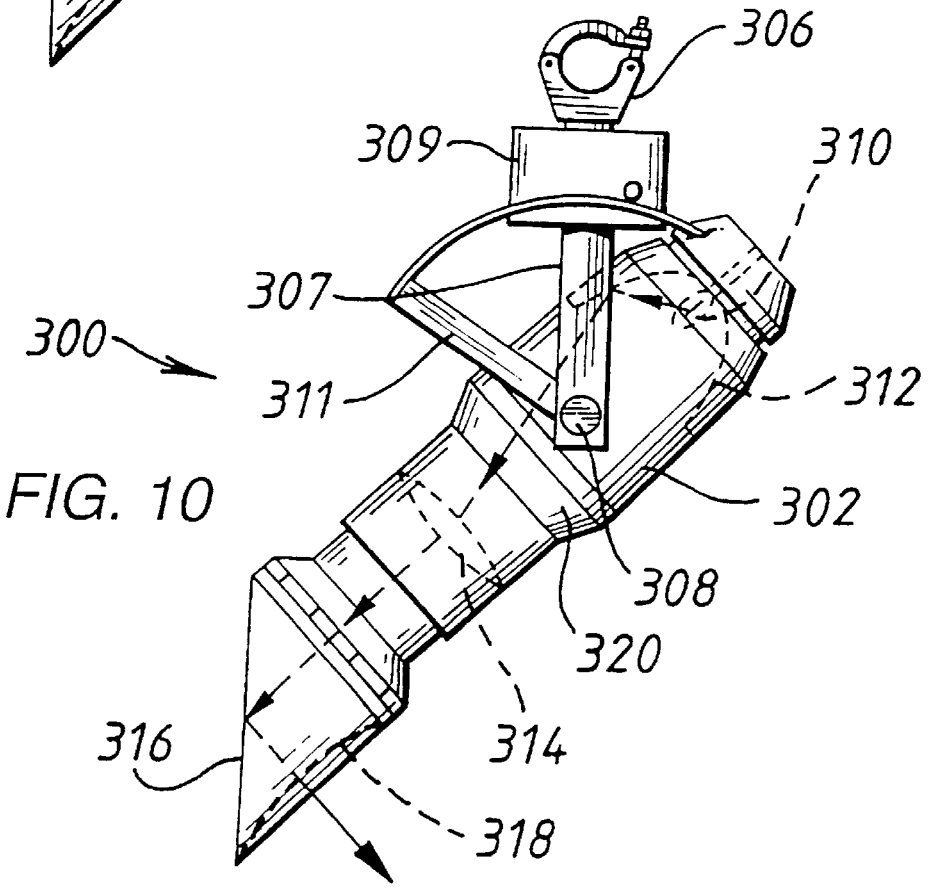
FIG. 10 shows the optical path of the apparatus shown in FIG. 8.

FIG. 10 shows the optical path in the apparatus shown in FIG. 8. The light chamber 302 includes a light source 310 and a concave reflector 312 for providing a broad converging beam. A lens 314 focuses the beam to bring the beam reflected by the reflector into or out of focus as required. The beam subsequently strikes a planar reflector 316 housed in the pan 304 at an angle of about 45° to the central axis of the light chamber 302. The reflector 316 reflects the beam for output through the aperture 318 in the pan 304.

The lens 314 may be situated at any position between the light source 308 and the planar reflector 316. Alternatively, or additionally, a lens may be situated between the planar reflector 316 and the aperture 318, or in the mouth of the aperture 318.

Apparatus for modifying the output of the apparatus so as to project an image on, for example, a stage may be provided between the light source 308 and the planar reflector 316. For example, a gobo or framing shutters can be conveniently housed within the conical portion 320 of the apparatus 300. As will be readily understood, the image projected by the apparatus will rotate with the rotation of the pan 304 due to the refection of the image by a 45° planar reflector. For example, if a gobo causes the apparatus to project an image of an arrow pointing upwards, 180° rotation of the pan 304 will rotate the image through 180° to an arrow pointing downwards.

In order to compensate for any rotation of the pan 304, for example so that the arrow points upwards at any position of the pan 304, there may be provided a system for rotating the gobo within the apparatus. This system may be mechanically and/or electrically linked to the panning motion of the pan so that the gobo rotates with the pan 304. In addition, or alternatively, there may also be provided a similar system for rotating framing shutters within the apparatus.

As discussed above, lens 314 focuses the beam to bring the beam reflected by the reflector into or out of focus as required. This is of particular importance when the apparatus includes a gobo; if the distance between the gobo, or object, and the image projected by the apparatus on to, for example, a stage varies, then it is important that the focus of the lens is varied as the image moves in order to keep the image in focus. The focus of the lens is typically variable electrically. Accordingly, any alteration of the focus of the lens may be made manually, or may be preprogrammed if the required movement of the image is predetermined.

An electronic range finder may be attached to the pan 304 for rotation therewith. An output from the range finder can be received by a control circuit which automatically changes the focus of the lens depending on the output of the range finder. As an alternative to changing the focus of the lens, the control circuit can output a signal to a mechanism within the apparatus for moving the gobo and/or framing shutters along the optical path. This latter alternative is preferable to changing the focus of the lens, as only a small movement of the gobo, of the order of millimetres, can produce a large change in the definition of the image.

Further variations and modifications will be apparent to one of skill in the art without departing from the spirit of the invention.

What is claimed is:

1. Beam steering apparatus comprising:

an apparatus body;

means in the body for generating a beam;

first and second rotatable reflectors, mounted on the body, for deflecting the beam in different directions, the beam being deflectable by the first reflector onto the second reflector so as to deflect the beam substantially in any direction;

a first motor for rotating the first reflector and for driving a first input to a gearbox; and a second motor for driving a second input to the gearbox, the gearbox having an output for rotating the second reflector, wherein the first and second motors are housed in the body, the gearbox output rotates the second reflector via a drive belt, rotation of the first reflector induces rotation of the second reflector, and the gearbox inputs and output are arranged to compensate for this induced rotation such that rotation of the second reflector by the second motor is unaffected by any rotation of the first reflector.

2. Apparatus according to claim 1, wherein the gearbox is a summation gearbox.

3. Apparatus according to claim 1, wherein the first reflector is arranged to rotate about a first axis and the second reflector is arranged to rotate about a second axis substantially orthogonal to the first axis.

4. A method of deflecting a beam by deflecting the beam off a first reflector on to a second reflector, and rotating both reflectors so as to deflect the beam substantially in any direction, the method comprising the steps of:

providing a first motor to rotate the first reflector and to drive a first input to a gearbox;

providing a second motor to drive a second input to the gearbox; and rotating the second reflector from the output of the gearbox, wherein the first and second motors are housed in a body, the gearbox output rotates the second reflector via a drive belt, rotation of the first reflector induces rotation of the second reflector, and the gearbox inputs and output are arranged to compensate for this induced rotation such that rotation of the second reflector by the second motor is unaffected by any rotation of the first reflector.

5. A method according to claim 4, wherein the gearbox is a summation gearbox.

6. A method according to claim 4, wherein the first reflector is rotated about a first axis and the second reflector is rotated about a second axis substantially orthogonal to the first axis.

7. Beam steering apparatus, comprising:

means for generating a beam;

means for rotating the generating means so as to rotate the beam;

a rotatable reflector for deflecting the beam; and means for rotating the reflector so as to deflect the beam substantially in any direction, wherein the generating means comprises a housing and a beam source is disposed within the housing, the housing having an aperture for outputting a beam generated by the beam source, and wherein the housing is rotatable about the beam source so as to rotate the aperture about the beam source, the beam source being stationary.

8. Apparatus according to claim 7, wherein the generating means is rotatable about a first axis, the beam source being spaced from the first axis.

9. Apparatus according to claim 7, wherein the generating means is rotatable about a first axis passing through said beam source.

10. Apparatus according to claim 7, wherein a part of the housing comprises a concave reflector for focusing a beam generated by the source on to the rotatable reflector.

11. Apparatus according to claim 10, wherein the spacing between the concave reflector and the source is variable to focus the generated beam.

12. Apparatus according to claim 7, wherein the spacing between the rotatable reflector and the generating means is variable.

13. Apparatus according to claim 7, further comprising means for focusing the beam disposed between the generating means and the rotatable reflector.

14. Apparatus according to claim 13, wherein the spacing between the focusing means and the generating means is variable to focus the generated beam.

15. Apparatus according to claim 7, further comprising means for focusing the beam reflected from the rotatable reflector.

16. Apparatus according to claim 15, further comprising at least one of a gobo and framing shutters disposed between the-rotatable reflector and the means for focusing the beam reflected from the rotatable reflector.

17. Apparatus according to claim 16, comprising means for moving said at least one of a gobo and framing shutters along the optical path of the apparatus.

18. Apparatus according to claim 16, comprising means for rotating said at least one of a gobo and framing shutters relative to the apparatus.

19. Apparatus according to claim 13, further comprising at least one of a colour changer, a colour mixer, an iris-type diaphragm and a dimmer disposed between the generating means and the focusing means.

20. Apparatus according to claim 7, further comprising a housing for the rotatable reflector, the reflector housing comprising an aperture for outputting a beam from the apparatus, the aperture including means for preventing a beam which has not been reflected by the rotatable reflector from being output from the apparatus.

21. Apparatus according to claim 20, wherein the preventing means comprises a collimator mounted on the aperture.

22. Apparatus according to claim 7, wherein the generating means is arranged to rotate about a first axis and the rotatable reflector is arranged to rotate about a second axis substantially orthogonal to the first axis.

23. Apparatus according to claim 7, further comprising:

a first motor for rotating the generating means and for driving a first input to a gearbox; and a second motor for driving a second input to the gearbox, the gearbox having an output for rotating the rotatable reflector.

24. A method of deflecting a beam, comprising the steps of:

generating a beam;

rotating a generating means so as to rotate the generated beam; providing a reflector for deflecting the generated beam; and rotating the reflector so as to deflect the beam substantially in any direction, wherein the generating means comprises a housing and a beam source disposed within the housing, the housing having an aperture for outputting a beam generated by the beam source, and wherein the housing is rotated about the beam source so as, to rotate the aperture about the beam source.

25. A method according to claim 24, further comprising focusing the generated beam on to the reflector.

26. A method according to claim 24, wherein the generating means is rotated about a first axis and the reflector is rotated about a second axis substantially orthogonal to the first axis.

27. A method according to claim 24, wherein a first motor is provided to rotate the generating means and to drive a first input to a gearbox and a second motor is provided to drive a second input to the gearbox, the reflector being rotated from the output of the gearbox.

* * * * *